United States Patent [19]

Dornfeld

[11] Patent Number: 4,688,779

[45] Date of Patent: Aug. 25, 1987

[54] MACHINE TOOL VISE

[76] Inventor: Stanely Dornfeld, 1161 Cushman Ave., San Diego, Calif. 92110

[21] Appl. No.: 834,585

[22] Filed: Feb. 28, 1986

[51] Int. Cl.[4] ..... B25B 1/10

[52] U.S. Cl. ..... 269/244

[58] Field of Search ..... 269/279, 280, 282, 244, 269/247, 251

[56] References Cited

U.S. PATENT DOCUMENTS 2,868,091 1/1959 Du Bois ..... 269/251

FOREIGN PATENT DOCUMENTS 2068271 8/1981 United Kingdom ..... 269/244

*Primary Examiner*—Robert C. Watson

*Attorney, Agent, or Firm*—Charmasson & Holz

[57] ABSTRACT

A vise for holding workpieces for precision machining which allows rapid set up, consistent workpiece orientation during machining and rapid cleanup. A stationary jaw providing a reference surface close to the operator, is removeably attached to a supporting structure. A moveable jaw is translated by a threaded shaft passing through the fixed jaw. Grooves of the supporting structure guide the movable jaw's translation. Axial clamping loads are transmitted from one jaw to the other directly by the threaded shaft rather than the support structure. The grooved supporting structure only provides resistance to moments tending to bend the shaft. The stationary jaw is readily removable allowing reversal, replacement or cleaning. Removal of the stationary jaw allows easy removal of threaded shaft and moveable jaw for replacement or cleaning without unthreading. Very high precision can be obtained by moment resisting design of the jaw assemblies.

9 Claims, 5 Drawing Figures

MACHINE TOOL VISE

FIELD OF THE INVENTION

This invention relates to work holders and more specifically clamps and vises.

BACKGROUND OF THE INVENTION

A variety of vises are used to hold workpieces during machining operations. These vises must be secured to the machine bed and firmly hold the workpiece immobile against the machine tool force. At the same time, the vise must not exert excessive force on the workpiece which would distort the surface being machined. The vise must also not bend or distort, making precision machining impossible.

These vises should also be quickly adjustable, cleanable and allow the machinist to easily relate to drawing dimensions, tolerances and finish requirements. Set up time is a significant cost of machining operations as is removal and cleanup time. Reorientation of the workpiece during machining should be minimized to reduce cost and prevent confusion of drawing requirements.

Prior vises have generally been of two types. The first and older type, provides a support structure with a fixed jaw on one end with a crank driven threaded shaft driving a moveable jaw on the other end in grooves in the structure. This type is simple in construction, but required a heavy support structure (taking axial and bending clamping loads), a heavy threaded shaft (taking compression loads without buckling) and grooves with small tolerances in order to maintain dimensional stability. Set up required fixing the vise to the machine bed and cranking to accept and clamp the workpiece. Reorientation of the workpiece required replacement on the machine bed in many cases if a moveable jaw was used as the drawing reference or reorientation if the fixed jaw was used as the drawing reference surface. Although options such as hydraulic cranking and removable jaw plates reduced these problems, the vise remains heavy and subject to distortion by axial and bending clamping forces.

A more recent vise (supplied by KURT Manufacturing) retains the relative positions of the crank, moveable and fixed jaws, but extends the threaded shaft to the fixed jaw and provides a new offset interface between the moveable jaw and shaft. The new interface deflects a portion of the clamping force to hold the moveable jaw on the support structure. The objective of this force deflection is to improve dimensional precision by not allowing jaw movement within (the previously described) groove.

However, this force deflection adds additional forces tending to bend the threaded shaft and the supporting structure. It also requires that the portion of the exposed structure which mates with the moveable jaw be kept clean. Drit or chips may jam the moveable jaw, or worse, damage the mating surfaces under the deflected force, destroying dimensional precision.

Therefore, although the more recent vise design offers advantages over the older design, the problems of weight, costly setup, disassembly, reorientation and cleaning time remain. In addition, new problems of inability to maintain dimensions when loose and increased risk of damage by dirt and chips has been observed.

Prior vises did not allow clear access from the top to bolt the units on a machine. These vises could only be bolted down from the bottom or by means of side clamps. This made it practically impossible to gang several vises side by side on a machine; unless they were first assembled up-side down on a platen. Removal of the vise for clean-up or repair required the removal of the entire gang.

Numerically controlled machinery is commonly programmed along cartesian coordinates. The axes zero reference is usually indicated as the lower left corner of the workpiece on the blueprints. If the operator is not provided with a stable reference point on the vise which is located on his side of the workpiece, he must either read the blueprint upside down or convert all given dimensions by translation to a stable reference point on the vise. Either one of these palliative measures yield values which are no longer consistent with the data used to program the machine.

SUMMARY OF THE INVENTION

The principal and secondary objects of the invention are:

- to provide a vise where a fixed reference surface is coincident with blue-print references used in connection with numerically programmed machines;
- to provide a vise which disassembles quickly for rapid cleaning, setup and reorientation;
- to provide a lighter weight vise with excellent dimensional stability while clamped or unclamped; and
- to provide a vise which directly transmits clamping forces to both jaw forces.

These and other objects are achieved by a stationary slotted jaw removeably attached to a vise support structure. A threaded shaft driven by the operator passes through the stationary jaw slot to engage the moveable jaw, which is translated within grooves in the support structure by rotation of the shaft. The supporting structure only resists machining and clamp bending forces, while the threaded shaft tension resists axial clamping forces. Stationary and moveable jaws can be quickly reversed or replaced to obtain rapid setup or disassembly. The constant reference surface adjacent to the operator minimizes reorientation time and errors. Dimensional stability clamped or unclamped is assured by grooves and minimizing the forces on these grooves.

DESCRIPTION OF THE PREFERRED EMBODIMENT OF THE INVENTION

Figure 1:
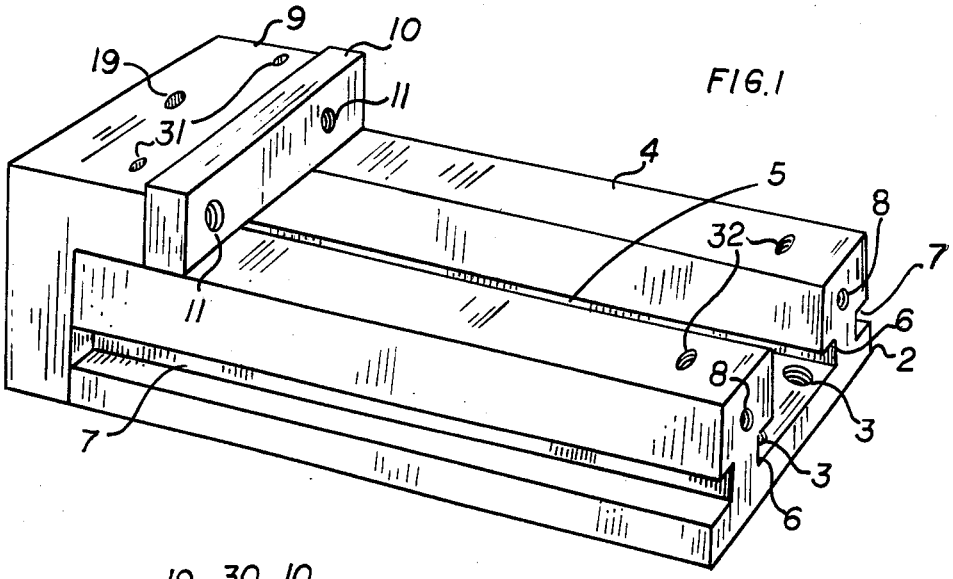
FIG. 1 is a perspective view of the vise support structure and fixed jaw.

Referring now to the drawings, FIG. 1 is a perspective view of the vise mounting structure and fixed jaw. The figure shows a support plate or sole 2 with holes 3 for hold down bolts (not shown for clarity). Hold down bolts would attach vise support plate 2 to a machine tool bed (not shown for clarity). First guide block 4 and second guide block 5 are rigidly bonded or welded to support plate 2 to form a solid one piece support structure. Each guide block has an interior groove 6 and an exterior groove 7. The pair of interior grooves 6 and support plate 2 provide a precision machined surface for the moveable jaw shown in FIG. 3. The pair of exterior grooves 7 provides additional areas for hold down clamps to firmly attach the support plate 2 to machine tool bed (not shown for clarity). Each guide block has a threaded end hole 8 on an end face. This provides for optional bolting of a fixed jaw shown in FIG. 4.

A fixed jaw option is shown in FIG. 1 abutting one end of the guide blocks and support plate 2. Full stationary jaw 9 is resting on guide blocks 4 and 5. Jaw plate 10 is attached to stationary jaw 9 by threaded retainers (not shown for clarity) in threaded holes in stationary jaw 9 and matching retaining holes 11 in jaw plate 10.

Figure 2:
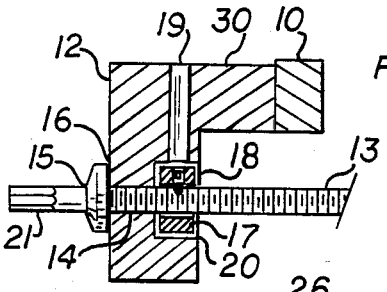
FIG. 2 is a median cross-section of the fixed jaw.

FIG. 2 shows a cross section of a stationary jaw 12. Threaded shaft 13 passes through slot 14, which could also be a hole, with a dimension larger than threaded shaft 13. Tension bearing surface or flange 15 and washer 16 is attached to threaded shaft 13, preventing axial movement of the shaft toward the stationary jaw 12. A sleeve 17 is attached to the threaded shaft 13 by a set screw 18. Access to set screw 18 is by jaw hole 19. Sleeve 17 prevents inward axial movement along the threaded shaft, and is placed in recess 20 when space is limited between guide blocks 4 and 5, support plate 2 and stationary jaw 12. A splined end 21 of threaded shaft 13 is provided for a means to rotate the threaded shaft.

Figure 3:
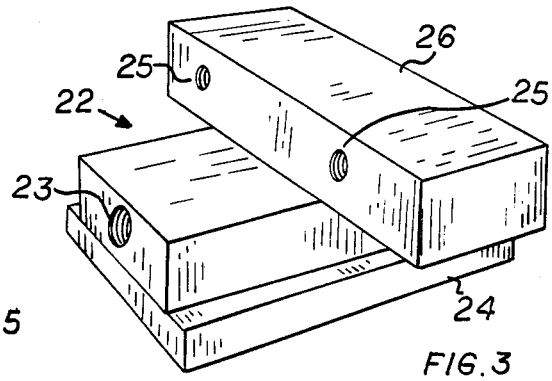
FIG. 3 is a perspective view of the moveble jaw.

FIG. 3 is a perspective view of a moveable jaw. Threaded shaft 13 engages threaded hole 23 in moveable jaw 22. Moveable jaw base 24 provide precision machined surfaces matching interior grooves 6 shown in FIG. 1. Screw holes 25 provide a means to attach a jaw plate shown in FIG. 4. Both the stationary jaw 12 shown in FIG. 2 and moveable jaw 22 are reversible on support plate 2 and guide blocks 4 and 5. Cross arm 26 rests on guide blocks 4 and 5. One can understand that the periphery of any transversal cross-section of the base 24 is in close sliding contact with the grooved inner walls of the guide blocks 4 and 5. The large contact surface between the moveable jaw base 24 and cross arm 26 with the support structure provides a high degree of stability. The length of the base 24 can be dramatically reduced without substantial loss of stability in order to increase the jaw aperture range.

Figure 4:
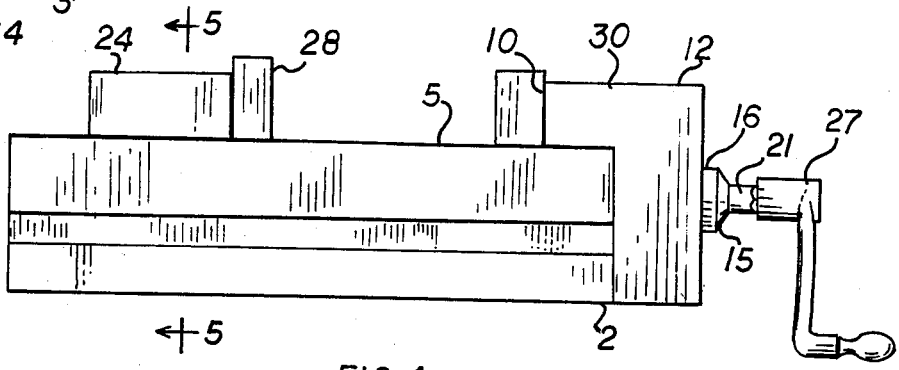
FIG. 4 is a side view of the assembled vise.

FIG. 4 shows an assembled vise. A crank 27 is attached to the splined end 21 of threaded shaft 13. Flange 15 restrains axial movement of stationary jaw 12 attached to jaw plate 10. Guide block 5 provides support for stationary jaw 12 and moveable jaw 22. A moveble jaw plate 28 is attached to moveable jaw 22 to provide a precision machined surface to clamp the workpiece together with jaw plate 10. Guide block 5 is bonded to support plate 2 to provide dimensional stability.

It should be noted that the forward section 29 of the moveable jaw base 24 passes under the jaw plate 10 and head 30 of the stationary jaw 9 in order to allow the jaws to fully come together. The feet 24 could be extended beyond the back of the moveable jaw in order to provide additional stability.

For further stability the stationary jaw 9 can be bolted to the top surfaces of the guide blocks 4, 5 through bores 31 into threaded holes 32 located at both ends of the guide blocks. Alternatively the head 30 of the stationary jaw 9 could be secured to the sole 2 and guide blocks 4, 5 from underneath.

Figure 5:
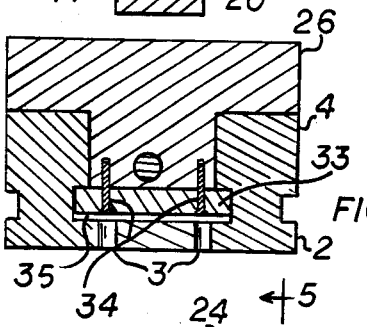
FIG. 5 is a cross-sectional view taken along line 5—5 of FIG. 4.

FIG. 5 further illustrates the construction of the moveable jaw 22 and its relationship with the supporting structure 2. The base 24 comprises a separate plate 33 bolted to the core of the base 34. The main part of the base is integral with the cross-arm 26. A gap 35 between the plate 33 and the upper surface of the sole 2 provide for the evacuation of filings or shavings as well as clearance for the heads of the bolts used to secure the vise to the machine through holes 3. It is noteworthy that the holes 3 are easily accessed through the top of the unit allowing for complete removal of the vise without requiring access to the understructure.

For further stability the stationary jaw 9 can be bolted to the top surfaces of the guide blocks 4, 5 through bores 31 into threaded holes 32 located at both ends of the guide blocks. Alternatively the head 30 of the stationary jaw 9 could be secured to the sole 2 and guide blocks 4, 5 from underneath.

FIG. 5 further illustrates the construction of the moveable jaw 22 and its relationship with the supporting structure 2. The base 24 comprises a separate plate 33 bolted to the core of the base at 34. The main part of the base is integral with the cross-arm 26. A gap 35 between the plate 33 and the upper surface of the sole 2 provide for the evacuation of filing or shaving as well as clearance for the heads of the bolts used to secure the vise to the machine through holes 3. It is noteworthy that the holes 3 are easily accessed through the top of the unit allowing for complete removal of the vise without requiring access to the understructure.

While the preferred embodiment of the invention has been described, other embodiments and configurations may be devised without departing from the spririt of the invention and the scope of the appended claims.

What is claimed is:

1. A vise for clamping a workpiece to a machine bed which comprises:

a parallelepipedal mounting structure defining a horizontal groove in its top surface and having at least three other generally planar exterior surfaces parallel to said groove and two opposite symmetrical end - faces perpendicular to said groove, each of said end-faces having means for mounting a stationary jaw;

means within said horizontal groove for attaching said mounting structure to said machine bed;

a movable jaw having a generally planar surface for mounting a first moveable jaw plate approximately perpendicular to the major dimension of said horizontal groove said moveable jaw having a sliding base engaging said groove, said base engagement extending in both directions along said groove from the intersection of said moveable jaw plate mounting surface plane and said groove;

said moveable jaw having a threaded hole along an axis parallel to said groove;

a threaded shaft engaging said threaded hole in said moveable jaw;

a stationary jaw mounted on one of said end-faces said stationary jaw having a surface positioned to mount a second jaw plate in cooperating opposition to said moveable jaw plate mounting surface for holding said workpiece, said stationary jaw plate mounting surface being in a plane intersecting said groove within said mounting structure;

a slot in said stationary jaw which allows passage of said threaded shaft;

a tension bearing means on said threaded shaft acting against said stationary jaw for limiting the axial movement of the shaft toward said moveable jaw; and a means for rotating said threaded shaft, said means for rotating being located at the stationary jaw end of the shaft.

2. The vise claimed in claim 1, wherein said mounting structure comprises a sole and a pair of parallel, spaced apart guide blocks supported by said sole and having horizontal recesses along their inner walls defining said groove;

said stationary jaw is mounted against one end of said guide blocks; and said moveable jaw comprises a base shaped and dimensioned so that the periphery of its transversal crosssection is in sliding contact with the inner walls of said guide blocks and a cross arm mounted across and above said base and having each of its ends in sliding contact with the upper surface of said guide blocks.

3. The vise claimed in claim 2, which further comprises:

a means to removeably attach said stationary jaw to said mounting structure;

jaw plate attached to said fixed jaw for contact with said workpieces; and a moveable jaw plate attached to said moveable jaw for contact with said workpiece.

4. The vise claimed in claim 3, wherein said moveable jaw is shaped to be reversed within said groove and said moveable jaw plate can be repositioned to contact said workpiece.

5. The vise claimed in claim 4, wherein said guide groove extends the total length of said mounting structure to allow assembly or disassembly of said moveable jaw and said engaged threaded shaft from either end of said guide grooves.

6. The vise claimed in claim 5 which further comprises a plurality of stationary jaws shaped and dimensioned to be interchanged with said stationary jaw at either end-face of said mounting structure, said plurality of stationary jaws having a different dimension from the intersection of said stationary jaw plate mounting surface plane and said groove, to said mounting end-face of said supporting structure.

7. The vise claimed in claim 6, wherein said threaded hole in said moveable jaw is bored through said base.

8. The vise claimed in claim 2, wherein said tension bearing means comprises a flange attached to said threaded shaft.

9. The vise claimed in claim 2, wherein said means for attaching comprises said sole having a plurality of vertical openings bored therethrough and located within said groove on either side of said shaft so as to be accessible from the top of the vise.

* * * * *